United States Patent [19]

Saito et al.

[11] Patent Number: 4,735,074

[45] Date of Patent: Apr. 5, 1988

[54] ONE-PASS TYPE CONTINUOUS MULTI-STAGE ROLL MILL AND ROLLING METHOD

[75] Inventors: Yoshihiro Saito, 4-9, Kofudai 3-chome, Toyono-cho, Toyono-gun, Osaka; Takefumi Kasajimia, Fujisawa; Mitsuyoshi Iwasaka; Toshinori Watanabe, both of Shizuoka, all of Japan

[73] Assignees: Dowa Mining Co., Ltd., Tokyo; Yoshihiro Saito, Osaka, both of Japan

[21] Appl. No.: 876,766

[22] Filed: Jun. 20, 1986

[30] Foreign Application Priority Data

Aug. 28, 1985 [JP] Japan ..... 60-189200

[51] Int. Cl.[4] ..... B21B 1/08; B21B 27/10; B21B 39/14

[52] U.S. Cl. ..... 72/234; 72/43; 72/201; 72/232; 72/250

[58] Field of Search ..... 72/232, 233, 199, 234, 72/226, 240, 205, 242, 365, 366, 250, 43, 44, 41, 236, 201

[56] References Cited

U.S. PATENT DOCUMENTS

| | | | |
|---|---|---|---|
| 1,074,824 | 10/1913 | Wadsworth | 72/232 X |
| 3,238,756 | 3/1966 | Coffin, Jr. | 72/234 X |

FOREIGN PATENT DOCUMENTS

| | | | |
|---|---|---|---|
| 0048405 | 4/1980 | Japan | 72/232 |
| 0088943 | 7/1980 | Japan | 72/234 |
| 0141301 | 11/1980 | Japan | 72/234 |
| 0127905 | 7/1984 | Japan | 72/234 |
| 0199104 | 11/1984 | Japan | 72/232 |

*Primary Examiner*—Robert L. Spruill
*Assistant Examiner*—Steve Katz
*Attorney, Agent, or Firm*—Frishauf, Holtz, Goodman & Woodward

[57] ABSTRACT

A multi-stage roll mill for producing a lengthy continuous rolled sheet material by a one-pass operation, comprises a driven central working roll, and a plurality of peripheral working rolls arranged spaced apart and on the periphery of the central working roll, the diameter of each of the peripheral working rolls being much smaller than that of the central working roll. Each peripheral working roll has a screw-down mechanism which is capable of freely adjusting the gap between the periphery of the peripheral working roll and the periphery of the central working roll. The peripheral working rolls are arranged in such a manner that the work being held in the gap between the peripheries thereof and the periphery of the central working roll is subjected to continuous multi-stage rolling.

7 Claims, 4 Drawing Sheets

ONE-PASS TYPE CONTINUOUS MULTI-STAGE ROLL MILL AND ROLLING METHOD

BACKGROUND OF THE INVENTION

The present invention relates to a roll mill which allows a flat sheet to be continuously rolled mainly transversally or in the direction of its width. The present invention also relates to a rolling method which uses said roll mill to produce a flat sheet or a sheet with a special cross section having one or more longitudinal grooves of a desired shape on one side.

Sheets with special cross sections are conventionally produced by cutting, rolling or the combination of V-shaped dies and plain surface rollers. From the viewpoints of productivity and cost, the rolling method is considered to be most advantageous and many techniques have been proposed to implement this method. They are roughly divided into two types: according to the first type, a flat sheet is worked with a pair of rolls one of which has a projection that corresponds to the shape of the groove which is to be formed in the final product; in the second type of technique, a train of rolls having projections of slightly varying widths are employed, with inclined or arced reduction surfaces being provided on the lateral edges of each projection, and the width of a groove on the flat sheet is gradually increased by feeding it in the direction in which the width of projections increases. The groove formed by the first approach has a tendency to become undulate because of the difference in the degree of working as between the groove and other portions of the sheet. In order to avoid this problem, a comparatively thick sheet must be subjected to gradually increasing amounts of draft and this requires an increased number of passes and intermediate heat treatments. In addition, deep grooves cannot be formed by this method. A further disadvantage results from the fact that high rolling loads necessitate large equipment. In the second approach, reduction is taken only on the lateral sides of a groove and a sufficient amount of flow deformation occurs in the direction of the width of the sheet to minimize the formation of an undulate groove. Another advantage is the development of low loads during rolling operations. However, this method has the disadvantage of complicated operations since the sheet must be worked with a number of rolls having projections of different widths. This problem could be avoided by performing continuous operation on rolls arranged in tandem but in this case, it is essential to control the speed or tension at which the sheet travels from one roll stand to another. This requires not only the appropriate control devices but also a separate drive mechanism for each stand, which inevitably leads to the use of large equipment.

SUMMARY OF THE INVENTION

The principal object, therefore, of the present invention is to eliminate the aforementioned defects of the existing rolling methods and to provide a novel and highly compact roll mill for producing a sheet having a special cross section, as well as a rolling method which employs such a mill.

In accordance with one aspect of the present invention, a single central working roll whose diameter is larger than its body length is combined with a plurality of much smaller-diameter working rolls which are arranged on the periphery of said central roll and are individually provided with a screw-down mechanism in such a manner that two or more stages of rolling are realized on a single mill in one pass through the rolls.

In accordance with another aspect of the present invention, a trapezoidal holding plate is provided between two adjacent peripheral working rolls and the central working roll in the mill in such a manner that the two inclined sides of said trapezoidal plate are in slidable contact at the lower parts thereof with the peripheries of said peripheral working rolls while a small channel through which the work can pass is formed between the underside of said holding plate and the periphery of said central working roll. This holding plate serves to constrain the work onto the periphery of the central working roll, thereby permitting the work to spread easily in transversal direction.

In accordance with still another embodiment of the present invention, a plurality of peripheral working rolls each having one or more projections on its periphery are arranged on the periphery of the central working roll in the increasing order of the width, height or number of said projections, and the work in a flat sheet form is introduced into the mill at the peripheral working roll having the smallest width, height or number of said projections such that the work on the periphery of said central working roll is continuously rolled mainly in transversal direction under the pressure exerted by said peripheral working rolls.

PREFERRED EMBOIDMENT OF THE INVENTION

The present invention is hereunder described in detail with reference to the embodiment shown in FIGS. 1 to 6, wherein 1 is the work, 2 is the central working roll, 3 is a peripheral working roll, 3' is a projection on the roll surface, 3'' is the roll body, 3''' is a gap defining ring, 4 is a trapezoidal holding plate, 5 is a spring by which the trapezoidal holder 4 is pressed against a peripheral working roll, 6 is a guide, 7 is a hole through which a coolant is supplied, 8 is a coolant wiper, 9 is a chock for the central working roll, 11 is a housing, 12 is a chock for a peripheral working roll, 14 is a feed guide roll, 15 is an entering guide, 16 is a deflector roll, and 17 is a takeup roll. The suffixes a to f attached to numerals 3 to 7 and 12 and 13 signify separate components of the same structure, and the suffixes a to e attached to numeral 1 signify different stages of rolling on the work.

Figure 1:
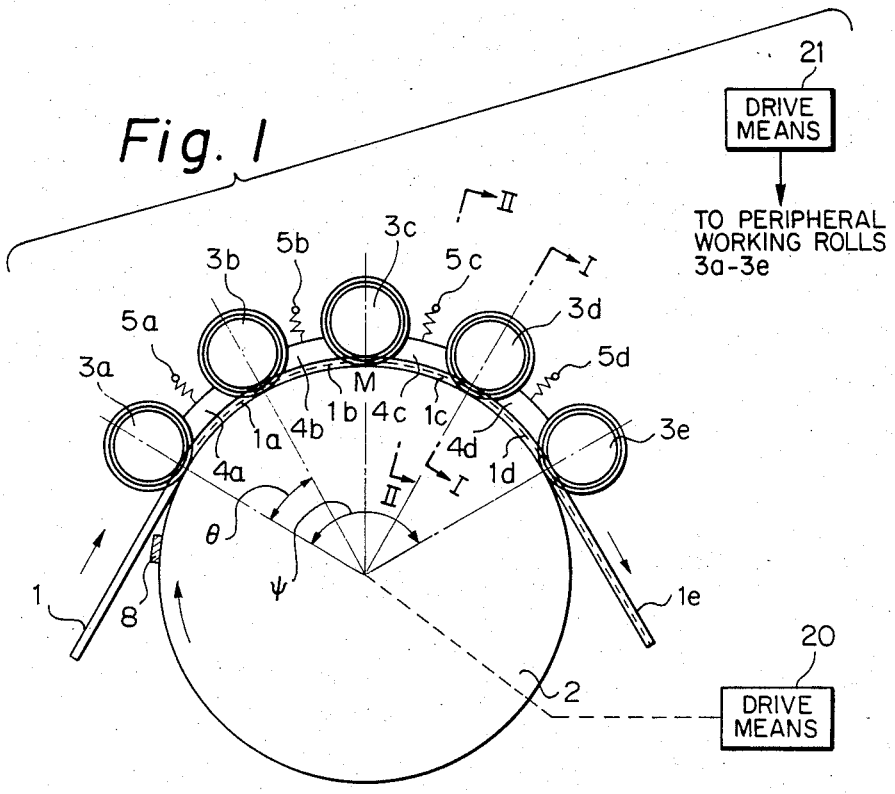
FIG. 1 is a front view showing the basic layout of rolls in the roll mill of the present invention.
Figure 2:
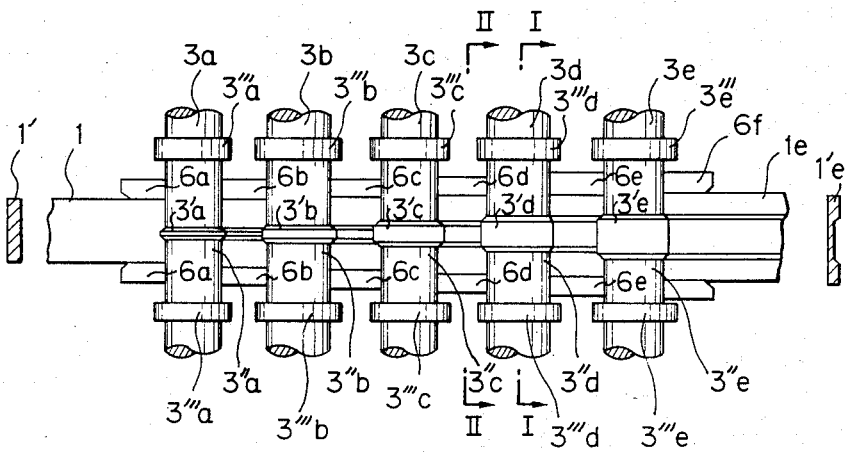
FIG. 2 is a plan view of FIG. 1 assuming that the peripheral working rolls are arranged in a horizontal plane.

The central working roll 2 is in the form of a flat disc whose diameter is greater than its body length. The roll 2 is supported on a vertically movable chock 9 and is driven by an electric motor (shown by drive means 20 in FIG. 1). Five peripheral working rolls, 3*a* to 3*e*, each being much smaller in diameter than the central working roll, are disposed on part of the periphery of the central working roll 2 at equal distances (in the embodiment shown, these rolls are spaced at $\theta=30°$ denotes the angle formed by two adjacent peripheral rolls with respect to the axis of the central working roll) in such a manner that the intermediate peripheral roll 3*c* is positioned at the highest point M on the periphery of the central working roll. The peripheral working rolls 3*a* to 3*e* are supported by chocks 12*a* to 12*e* (FIG. 6), respectively, each of which can be raised or lowered in the radial direction of the central working roll. The peripheral working rolls 3*a* to 3*e* are not driven at all, or they may be driven at a peripheral speed which is the same as that of the central working roll by means of drive means 21 shown in FIG. 1. Each of the peripheral working rolls 3*a* to 3*e* is provided with a projection 3′ that serves to reduce the cross-sectional area of a certain part of the width of the work. As the work 1 is fed between the central working roll 2 and the sequence of peripheral working rolls 3*a* to 3*e*, an increasing width of the work is subjected to rolling action at the five reduction-down points, and a flat sheet or a sheet having one flat surface but the other side of which has a special cross section will emerge from the mill after passing through the rolls. Roll pass design parameters such as the shape, width, height and layout of the projection on each peripheral working roll should be so selected that the longitudinal elongation of the work at each of the five reduction-down points which will otherwise be great in standard rolling operations is minimized. If one wants to obtain a non-flat sheet 1′*e* which is thicker on the side edges than in the central portion as shown in FIG. 2, the peripheral working rolls 3*a* to 3*e* may be provided with projections 3′ which have two inclined side edges with a round corner (the radius of curvature of each corner is indicated by r in FIG. 4) and which have the same height but vary in width (FIG. 4) which increases progressively toward the final stage of rolling. On the other hand, if one wants a non-flat sheet which is thicker in the center of its width than the other portions, projections may be provided on two side portions of the peripheral rolls such that the width of the projection increase toward the final stage of rolling. If a sheet of the desired shape is not attainable in a single pass through the rolls, another pass may be taken using a set of different shaped rolls. A flat sheet may be obtained by using a plain peripheral roll in the final stage of rolling, and this enables a flat sheet of broad width to be obtained in one pass through the rolls. A non-flat sheet having a plurality of longitudinal grooves can be obtained by arranging the peripheral working rolls 3*a* to 3*e* such as manner that the number of projections 3′ on the rolls increases from the center of the width of the sheet outward as the rolling operation approaches the final stage. If a sheet having a plurality of wide grooves is desired, the operator may use this technique in combination with a pass design that provides for an increased groove width.

Figure 4:
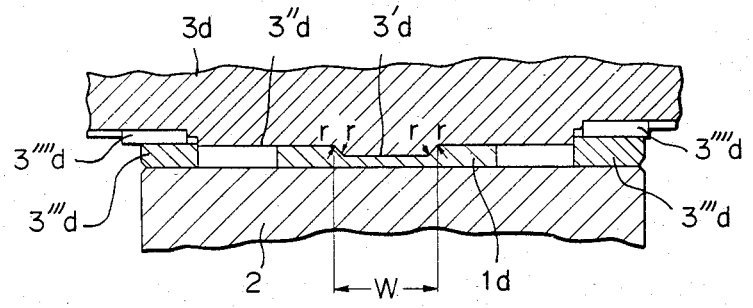
FIGS. 4 and 5 are cross sections taken on lines I—I and II—II of FIG. 1 or 2, respectively.

It is essential for the rolling method of the present invention that the roll gap at each stage of the rolling operation be set to the accurate value. In order to meet this requirement, a gap defining ring 3‴ is provided at each end of the roll body 3″ by means of a key 3⁗ as shown in FIG. 4. Precise gap control is achieved during rolling operations by screwing down the peripheral working rolls such that the peripheral surfaces of the gap defining rings will be held in contact with the peripheral surface of the central working roll.

In addition to the central and peripheral working rolls, the roll mill of the present invention has such basic components as a trapezoidal holding plate 4, guide 6, coolant supply hole 7, coolant remover 8, and takeup roll 17, each of which will be described hereinafter.

Figure 3:
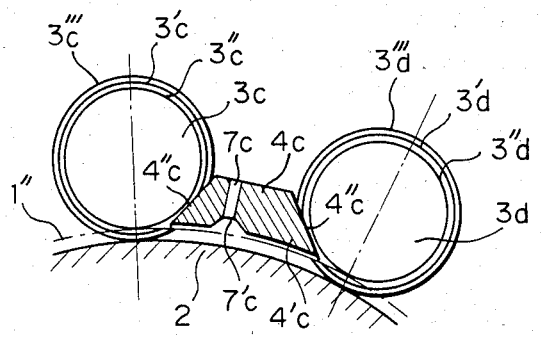
FIG. 3 is a partial enlarged view of FIG. 1.
Figure 5:
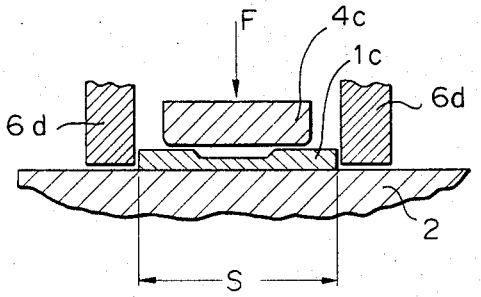

When the work being rolled elongates in the direction of rolling, the speed at which the work travels becomes slower than the peripheral speed of rolls on the entering side but faster on the delivery side. This means that in standard rolling procedures on a tandem mill, the peripheral speed of rolls which are closer to the delivery side must be made faster than that of rolls positioned closer to the entering side. In the roll mill of the present invention, the peripheral roll speed is the same at each stage of rolling operations and, in order to realize consistent rolling, the elongation which will occur at each stage of rolling must be substantially eliminated. The elongation occurring at each stage of rolling can be made smaller by reducing the width of the reduction-down area at each stage of rolling, but if rolling is performed in an unrestrained manner, it is generally impossible to eliminate such elongation completely. Under these circumstances, the speed at which the work leaves an upstream roll is faster than the speed at which it enters the adjacent downstream roll, causing the work to become bulged out between the two adjacent rolls. In order to avoid this problem, a trapezoidal holding plate 4 is provided between adjacent peripheral working rolls as shown in FIGS. 1, 3 and 5 such that the work will be constrained in the small area between the underside of the holding plate and the peripheral surface of the central working roll 2, thereby preventing the work from bulging out between the adjacent peripheral working rolls. In the presence of the trapezoidal holder 4, a longitudinal compressive stress will develop in the work between two adjacent peripheral working rolls and the work is rolled by the action of this compressive stress in a sufficient amount to inhibit elongation of the work while promoting its flow deformation in the direction of its width. As a consequence, large lateral spread can occur, which could not be realized by the conventional methods of rolling. FIG. 3 illustrates the relationship between the holder 4*c*, peripheral working rolls 3*c* and 3*d* and the central working roll 2. One-short-and-one-long dashed line 1″ indicates the upper surface of the thicker portion of the work, and consistent rolling is realized by setting the clearance between said upper surface and the underside 4′*c* of the trapezoidal holder at a value which is within the range of 0.2–0.5 times the maximum thickness of the work. In order to ensure this clearance, the shape of the trapezoidal holding plate may be designed as shown in FIG. 3 such that the two inclined sides 4″*c* of the plate are supported at the lower part by the peripheral surfaces of the two adjacent peripheral working rolls and that an optimum clearance is automatically provided when the roll gap is set to a predetermined value.

In the presence of the so designed trapezoidal plate 4, the work being rolled will slide in contact with the underside of the plate as it is held down by the plate. If the compressive stress developing in the longitudinal direction of the work is written as $\sigma\theta$, the width of the work S, and the average of its thickness t, then the force F exerted upon the work is given by:

$$F=2\sigma\theta\ St\sin(\theta 2) \quad (1).$$

Since $\sigma\theta$ is not greater than the compressive yield stress of the work $\sigma y$, F will satisfy the following relationship on the assumption that the angular distance between adjacent peripheral working rolls, $\theta$, is 30°:

$$F<0.5St\sigma_y \quad (2).$$

If S=40 mm, t=1 mm and $\sigma_y$=40 kgf/mm$^2$, F is smaller than 800 kgf. The compressive force F will be transmitted from the surfaces of two adjacent peripheral working rolls to the trapezoidal holding plate through sliding faces 4'', and onto the work through the other sliding face 4'. As a result, a frictional force which is in proportion to F will develop on these sliding faces; not only does this frictional force prevent the work from advancing in the rolling direction but it also causes the rolls and holding plate to wear while inducing the work to stick to the underside of the holding plate by fusion. Therefore, in order to decrease the contact pressure which induces friction and wear of the sliding faces, the contact area of the sliding surfaces is made as large as possible. Furthermore, in order to decrease the frictional force developing at the sliding faces, the trapezoidal holding plate is so designed that at least the sliding surfaces of the plate are made of a material that has a low frictional coefficient and which exhibits high resistance to wear and sticking by fusion and that said sliding surfaces are supplied with an adequate amount of a coolant having high lubricating and cooling capabilities. The coolant is injected toward the area of contact between each of the peripheral working rolls and the trapezoidal holding plate. Preferably, a through-hole 7 and a transversal groove 7' are formed in the trapezoidal plate as shown in FIG. 3 to provide channels through which the coolant is supplied to the upper surface of the work in an ample amount. However, the frictional force which develops between the central working roll and the work must be in a sufficient amount to permit the work to be smoothly fed through the roll mill. In order to meet this requirement, the central working roll should be supplied with the minimum necessary amount of the coolant to prevent the work from sticking to the surface of the central working roll by fusion. In the roll mill of the present invention, the central working roll is positioned below the work for the purpose of preventing the coolant from being supplied in an excess amount between the central working roll and the work. A wiper 8 is provided at a point immediately before the first bite (nip) on the peripheral surface of the central working roll so that an appropriate amount of the coolant is supplied between the work and the central working roll.

In order to form a groove of the desired width at a predetermined position on the work, the center of the pass in each of the peripheral working rolls must be in alignment with a single imaginary line running on the periphery of the central working roll. In order to meet this requirement, the individual peripheral working rolls are provided with separate thrust adjusting mechanisms (not shown). It is also required that the work be guided in such a manner that the center of its width is in alignment with the center of the pass in each peripheral working roll. To meet this requirement, a pair of guides 6 which constrain the work at two lateral sides thereof as shown in FIGS. 2 and 5 are provided not only between adjacent peripheral working rolls but also on the entering and delivery sides of the mill. The two members of each guide pair have flat surfaces that face each other, and are slidable in the direction of the axis of each peripheral working roll in a symmetrical manner with respect to the center of the pass of each roll so as to allow the distance between the two members of each guide pair to be freely adjustable.

Figure 6:
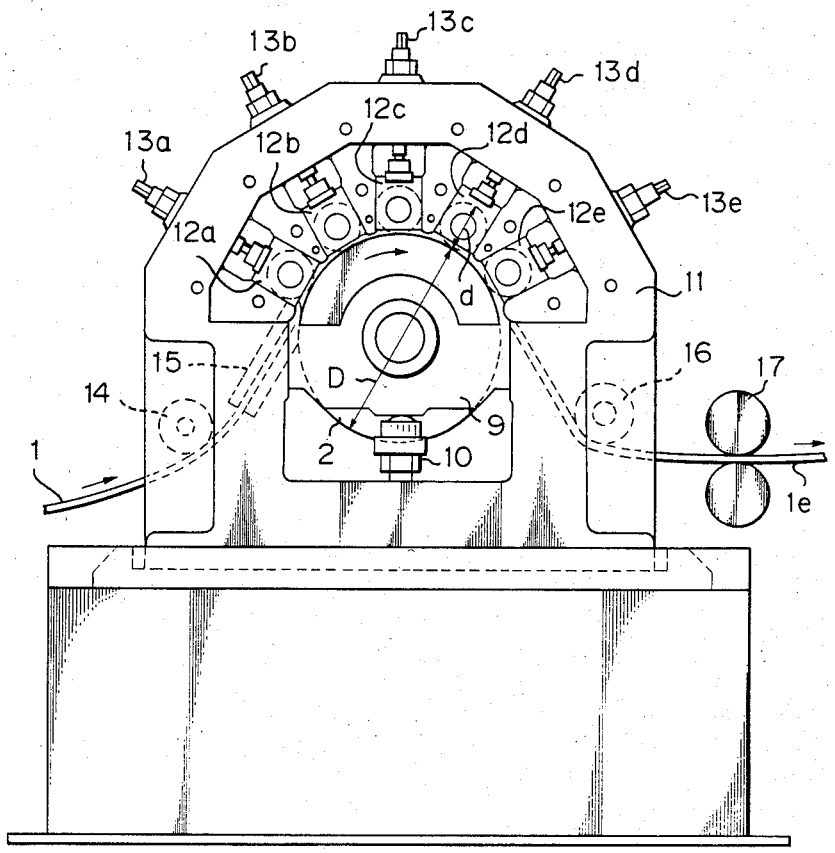
FIG. 6 is a front view showing one specific embodiment of the roll mill of the present invention.

The dimensions of the non-flat sheet to be produced having a special cross section or the degree of working necessary for producing the intended product may be such that the work cannot be fed through the roll mill by the driving force developed by the friction with the central working roll alone. In anticipation of this possibility, takeup rolls 17 having a rubber coat on their surface may be provided on the delivery side of the roll mill as illustrated in FIG. 6, such that the takeup force of these rolls is combined with the driving force of the central working roll. The takeup rolls 17 also serve to guide the product to a windup frame (not shown).

The foregoing description concerns an embodiment wherein five peripheral working rolls are spaced at intervals equivalent to an angular distance ($\theta$) of 30°. It should, however, be noted that the number of peripheral working rolls (n) that can be employed and the angular distance ($\theta$) at which they are spaced from each other are by no means limited to the embodiment shown. The value of n may be two or any larger value and, the more rolls that are employed, the greater the number of stages of rolling that can be effected in one pass. On the other hand, the angle at which the work is wrapped around the central working roll, or the difference between the angle at which the work is inserted into the roll mill and the angle at which the work is withdrawn from the mill [$\phi=(n-1)\theta$] is increased and the overall mechanism of the roll mill becomes complicated to cause great inconvenience for the rolling operations. The other parameter, or the angular distance $\theta$, is limited by the ratio of the diameter of the central working roll (D) to the maximum diameter of the peripheral working roll or the diameter of the gap defining ring (d). As shown in FIG. 6, the peripheral working rolls are supported by the roll chocks 12. In order to avoid the chock guide grooves from interfering with each other at the periphery of the central working roll, the following relationship must be satisfied:

$$\sin\left(\frac{\theta}{2}\right) > \frac{d}{D}. \quad (3)$$

If the width at the tip of the toothed frame between two adjacent roll chock guide grooves [$(D/2)\sin(\theta/2)-d/2$] is d/6, $\theta$ is given by the following equation:

$$\sin\left(\frac{\theta}{2}\right) = \frac{4}{3}\left(\frac{d}{D}\right). \quad (4)$$

Equation (4) shows that $\theta$ can be made smaller by decreasing d/D. Since d is preferably large in order to ensure a high degree of rigidity from the viewpoint of the dimensional precision of the product, d/D must be made smaller by increasing D but this leads to the increase in the overall size of the equipment. In the embodiment shown, D and d are set at 350 mm and 70 mm, respectively, to select $\theta$=30°, and $\phi$ is set at 120° to select n=5.

Rolling with the above-described apparatus may proceed as follows. First, the central working roll is set at a predetermined height. It should be noted that the position of the central working roll need not be changed except when the rolls, trapezoidal holding plates and guides are replaced. Next guides 6a to 6f are set in position. The distance between the two members of each guide pair is made equal to the width of the piece which is calculated on the assumption that the cross-sectional area of the piece which has passed under each peripheral working roll is equal to that of the work before it is rolled. This assumption is equivalent to the absence of any elongation that may occur in the longitudinal direction of the work as a result of rolling. In actual rolling operations, however, some elongation is introduced into the work and the guide gap defined above must be larger than a theoretically optimum value. In the next step, the peripheral working rolls are raised to provide a gap that permits the free passage of the work, which is fed into the roll mill through the guide roll 14 and entering guide 15, then passed through the opening between the central working roll and the peripheral working rolls, and finally is pulled into the opening between the takeup rolls 17 after being guided by the deflector roll 16. Subsequently, the central and peripheral working rolls are rotated at low speed with a coolant being supplied, and at the same time, screws 13 are tightened, with screw 13a closest to the entering side being adjusted first, until the gap defining rings on the rolls 3a, 3b, 3c, 3d and 3e come into contact with the central working roll. Then, the distance between the two members of each guide pair is adjusted in the order of 6a, 6b, 6c, 6d, 6e and 6f such that the gap between each guide pair and the work becomes substantially zero. After adjustment of the screws and guides is completed, the rotational speed of the rolls is gradually increased to attain a steady rolling operation.

The dimensions of the work which are optimal for producing desired non-flat sheets having special cross sections may be determined by conducting forming experiments in accordance with the above-described procedures on several pieces of work having different widths and thicknesses.

Figure 7:
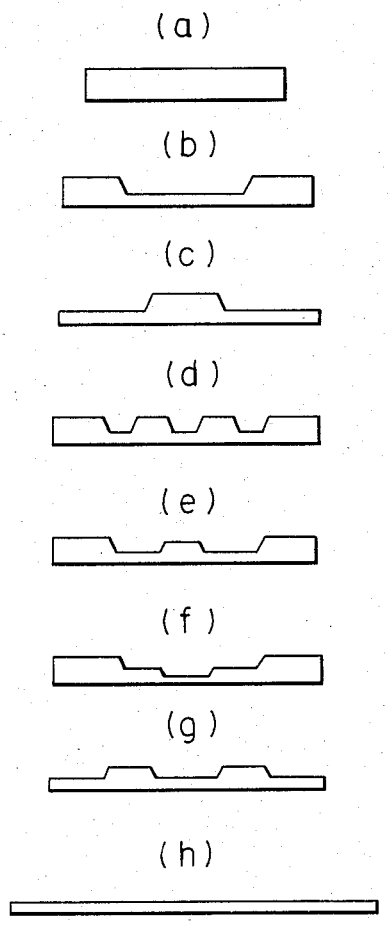
FIG. 7 shows in cross section the stock to be worked by the roll mill of the present invention and several products obtained by the rolling operation on that mill.

The work and several products obtained by operating the roll mill and the rolling method of the present invention are depicted in FIG. 7, wherein (a) is the work, (b) to (g) are non-flat sheets having various cross sections, and (h) is a thin flat sheet. The non-flat sheets shown in FIG. 7 are symmetrical in cross section but the roll mill of the present invention which provides heavy constraints on the work by guides is capable of producing strips having non-symmetrical cross sections if their asymmetry is not extreme.

The roll mill of the present invention differs from the conventional two-high tandem mill which consists of several single stands each containing one pair of top and bottom rolls. In the mill of the present invention, a single large-diameter central working roll is combined with a plurality of much smaller-diameter working rolls arranged on the periphery of the central working roll, and a trapezoidal holding plate is positioned between adjacent peripheral working rolls so that it will introduce a large compressive stress to prevent the work from increasing in length as it is reduced in cross-sectional area by passage between the central working roll and the sequence of peripheral working rolls. In addition, the peripheral working rolls are provided with projections that increase in width or number progressively toward the delivery side of the mill such as to put limits on the substantial width of rolling at each stage. This design is effective for the purpose of substantially eliminating or at least limiting the increase in length of the work being rolled, thereby allowing the work to be continuously rolled mainly in the direction of its width. As a result, the method of the present invention permits the production of not only flat sheets but also non-flat sheets of various cross sections by enabling the work to be continuously rolled mainly in trans- versal direction on a single unit of mill in one pass through the working rolls. In spite of using a large number of rolls, the roll mill of the present invention is compact in size. Furthermore, the initial cost of the mill is very low since it eliminates the need for setting and controlling the speed of each roll, which is essential in the tandem mill.

What is claimed is:

1. A one-pass type continuous multi-stage roll mill, for rolling a workpiece mainly in its transverse direction, comprising:

a central working roll;

drive means coupled to said central working roll for rotatably driving said central working roll;

a plurality of rotatable spaced apart peripheral working rolls which are mounted adjacent the periphery of said central working roll;

a screw-down mechanism coupled to each of said peripheral working rolls; and a plurality of work holding members, each of said work holding members being arranged between two adjacent peripheral working rolls and adjacent said central working roll, each work holding member having inclined faces on opposite sides thereof which are in slidable contact with the peripheries of said respective two adjacent peripheral working rolls, each work holding member having a lower surface portion spaced from the periphery of said central working roll and defining a channel through which a workpiece can pass between said lower surface portion of each of said work holding members and the periphery of said central working roll, said channel being dimensioned such that the workpiece passing therethrough is constrained by said lower surface positon onto the periphery of said central working roll, so that the workpiece, during rolling, can spread easily in its transverse direction;

each of said peripheral working rolls having a diameter which is much smaller than that of said central working roll; and said peripheral working rolls and said work holding members being arranged such that the workpiece passing and being worked between the periphery of each peripheral working roll and the periphery of said central working roll, and passing and being constrained between said lower surface portion of each work holding member and the periphery of said central working roll is subjected to continuous multi-stage rolling mainly in the transverse direction of the workpiece.

2. A roll mill according to claim 1 wherein each of said work holding members has a hole through which an externally supplied liquid coolant is introduced to the work lying under said holding member.

3. A roll mill according to claim 1 or 2 wherein each of said peripheral working rolls comprises a gap defining ring having a periphery which is in slidable contact with the periphery of the central working roll.

4. A roll mill according to claim 1 or 2, further comprising guides arranged on the periphery of said central working roll for regulating the width and lateral position of the work.

5. A roll mill according to claim 1 or 2 wherein said plurality of peripheral working rolls each having peripheral surfaces which have contours that are complementary to predetermined shapes which gradually and successively approach the final cross sectional shape of the work after completion of its rolling.

6. A roll mill according to claim 5 wherein each of said peripheral working rolls has at least one projection on its periphery for providing at least one corresponding longitudinal groove in the final product of rolling.

7. A one-pass type continuous multi-stage rolling method for rolling a workpiece mainly in its transverse direction, comprising:

passing a workpiece between a driven central working roll and a plurality of rotatable spaced apart peripheral working rolls which are mounted adjacent the periphery of said central working roll, a working space being defined between the periphery of said central working roll and the peripheries of each of said peripheral working rolls, and each of said peripheral working rolls having a diameter which is much smaller than that of said central working roll;

providing a plurality of work holding members, each of said work holding members being arranged between two adjacent peripheral working rolls and adjacent said central working roll, each work holding member having inclined faces on opposite sides thereof which are in slidable contact with the peripheries of said respective two adjacent peripheral working rolls, each work holding member having a lower surface portion spaced from the periphery of said central working roll and defining a channel through which a workpiece is passable between said lower surface portion of each of said work holding members and the periphery of said central work roll, said channel being dimensioned such that the workpiece passing therethrough is constrained by said lower surface portion onto the periphery of said central working roll, so that the workpiece, during rolling, can spread easily in its transverse direction; and passing said workpiece between said peripheral working rolls and said work holding members such that the workpiece passing and being worked between the periphery of each peripheral working roll and the periphery of said central working roll, is constrained between said lower surface portion of each work holding member and the periphery of said central working roll so that said workpiece is subjected to said continuous multi-stage rolling mainly in the transverse direction of the workpiece.

* * * * *